United States Patent [19]

Sugita

[11] Patent Number: 4,958,400

[45] Date of Patent: Sep. 25, 1990

[54] LINE CLEANING APPARATUS

[76] Inventor: Masahiko Sugita, 8-24, Atago 3-Chome, Niiza-shi, Saitama Prefecture 352, Japan

[21] Appl. No.: 401,852

[22] Filed: Sep. 1, 1989

[30] Foreign Application Priority Data

Jun. 30, 1989 [JP] Japan ..... 1-77514[U]

[51] Int. Cl.[5] ..... E01H 1/05

[52] U.S. Cl. ..... 15/79.1

[58] Field of Search ..... 15/79 R, 79 A, 82, 83

[56] References Cited

U.S. PATENT DOCUMENTS

| | | | |
|---|---|---|---|
| 1,481,504 | 1/1924 | Chisholm . | |
| 1,987,371 | 1/1935 | Rudd . | |
| 2,006,632 | 7/1935 | Eichhammer . | |
| 2,136,676 | 11/1938 | Davis . | |
| 2,145,738 | 1/1939 | Sandberg . | |
| 2,727,265 | 12/1955 | Dunham . | |
| 3,092,862 | 6/1963 | Sherbondy . | |

FOREIGN PATENT DOCUMENTS

| | | | |
|---|---|---|---|
| 150651 | 3/1953 | Australia | 15/79 R |
| 2632098 | 1/1978 | Fed. Rep. of Germany . | |
| 2758736 | 7/1979 | Fed. Rep. of Germany | 15/79 R |
| 2836203 | 2/1980 | Fed. Rep. of Germany | 15/79 R |
| 23253 | of 1907 | United Kingdom | 15/79 R |
| 248887 | 3/1926 | United Kingdom | 15/79 R |

*Primary Examiner*—Edward L. Roberts

*Attorney, Agent, or Firm*—Nixon & Vanderhye

[57] ABSTRACT

A line cleaning apparatus includes a pair of frames with handle arms, a roller brush and a secondary roller respectively disposed between the frames at it leading and trailing ends thereof. The roller brush and the secondary roller are rotatably supported on the frames by shafts. A primary roller is disposed between the frames substantially at the central portion thereof, and is rotatably supported on the frames by a shaft. A pulley is rotatably provided on each end of the shafts, with a belt extending around a respective pair of pulleys in the form of a figure eight.

2 Claims, 4 Drawing Sheets

LINE CLEANING APPARATUS

BACKGROUND OF THE INVENTION

1. Field of the Invention

The present invention relates to a line cleaning apparatus. More particularly, the present invention concerns a line cleaning apparatus which is capable of removing sand or gravel on the boundary lines of a tennis court without leaving ruts on the tennis court.

2. Description of the Related Art

A hard, clay or lawn tennis court made up of the sidelines and baselines (which define the backcourts), service lines and service sidelines (which define the service courts), service center lines which divide the individual service courts, and the center marks drawn at the center of the individual baselines.

In the case of a hard court, these lines are drawn beforehand on sheets of rubber or on artificial turf pasted over a concrete base. In the case of a clay or lawn court, the lines are prepared by fixing white tapes to the court by means of tacks or the like.

In particular, the boundary lines provided on clay courts are likely to be covered by sand or dust, necessitating occasional cleaning.

Accordingly, it has been proposed to remove such and or dust on the ground by means of a rotating roller brush provided between two pairs of wheels by means of a driving wheel provided adjacent to the front wheels. Such an apparatus is disclosed in the specification of, for example, U.S. Pat. No. 309,286.

The cleaning apparatus disclosed in U.S. Pat. No. 309,286 forms, two ruts, i.e., two wheel tracks, along the lines during line cleaning since the two pairs of wheels are rolled on the ground to rotate the roller brush, thereby deteriorating the appearance of the lines.

SUMMARY OF THE INVENTION

In view of the aforementioned problem of the related art, an object of the present invention is to provide a line cleaning apparatus which allows one operator to clean the lines and their peripheral aeas without leaving any tracks.

To this end, the present invention provides a line cleaning apparatus which comprises a pair of frames with handle arms, a roller brush and primary and secondary rollers. The roller brush and secondary roller are respectively disposed between the frames at positions corresponding to the front and rear ends thereof, and are each rotatably supported on the frames by shafts. The primary roller is likewise disposed between the frames, but substantially at the central portion thereof, and is rotatably supported on the frames by a shaft. A pulley is rotatably provided on each end of the shafts which respectively supports the brush and primary roller, and a belt extends around a respective pair of these pulleys, in the form of a figure eight.

In the line cleaning apparatus according to the present invention, when the handle arms are pushed, the primary roller rotates, thereby rotating the roller brush by means of the belts in the direction reverse to that of the rotation of the primary roller. As a result, dust or sand on the lines and their peripheral areas on the court can be swept away in forward direction, and the lines can be therefore quickly and easily brushed form one end to another by one cleaning operation without leaving wheel tracks along the two sides of the lines.

DETAILED DESCRIPTION OF THE PREFERRED EMBODIMENT

An embodiment of the present invention will be described below with reference to the accompanying drawings.

Figure 1:
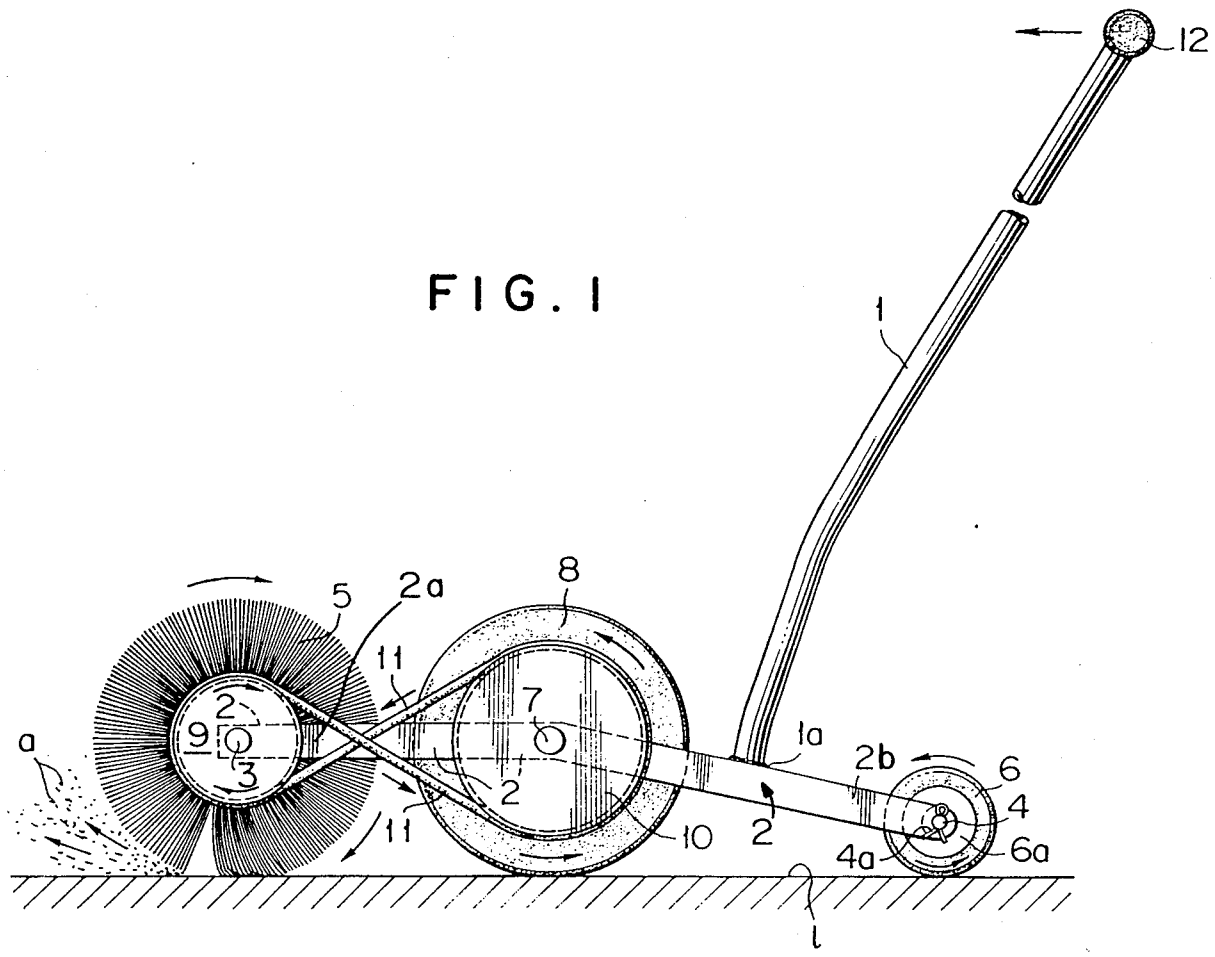
FIG. 1 is a side elevational view of a line cleaning apparatus, showing an embodiment of the present invention.
Figure 2:
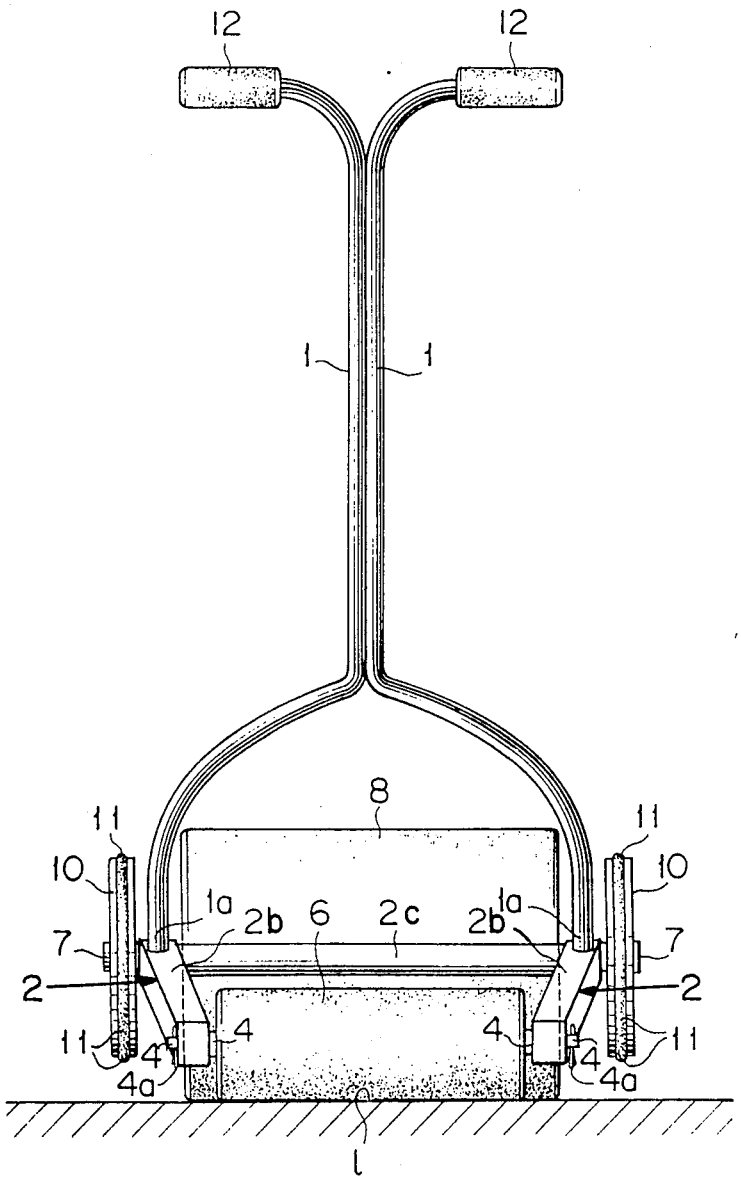
FIG. 2 is a rear view of the apparatus of FIG. 1.

As shown in FIGS. 1 and 2, a pair of handle arms 1 made of a metal pipe or the like protrude from a pair of laterally separated frame members 2 made of a square metal pipe or the like. The frame members 2 each include leading and trailing portions **2*a*, 2*b*, respectively. The frame members 2 are rigidly coupled one to the other by means of a cross brace 2*c* such that the leading arm portions 2*a* are substantially parallel to one another, while the trailing arm portions 2*b* converge towards one another (i.e. so as to accommodate the lesser axial dimension of secondary roller 6). A roller brush 5 and a secondary roller 6 are positioned between the separated frame members 2 at the front and rear ends thereof and are repsectively rotatably supported thereto by means of shafts 3 and 4 and bearings 3*a* and 4*a* (see FIG. 4). The roller brush 5 is composed of a core 5*a* and wear resistant synthetic resin fibers radially implanted on the periphery of the core 5*a*. The secondary roller 6 is preferably made of rubber or the like, while shafts 3 and 4** are preferably made of iron or the like.

A primary roller 8 is also disposed between the frame members 2 substantially at the central portion thereof. The main roller 8 is rotatably supported on the frame members 2 by means of a shaft 7 made of iron and bearings **7*a*. The primary roller 8 is covered by a rubber sleeve or the like. Grooved pulleys 9 and 10 are rotatably supported on each end of shaft 3 associated with roller brush 5 and on each end of shaft 7 associated with primary roller 8, respectively, such that the pulleys 9 and 10 are each laterally positioned adjacent an exterior side of the frame 2. A round or other shaped belt 11 of the type which does not expand much extends around the two pulleys 9 and 10** at each side of the rollers, the belt crossing between the pulleys to form a figure eight.

Figure 3:
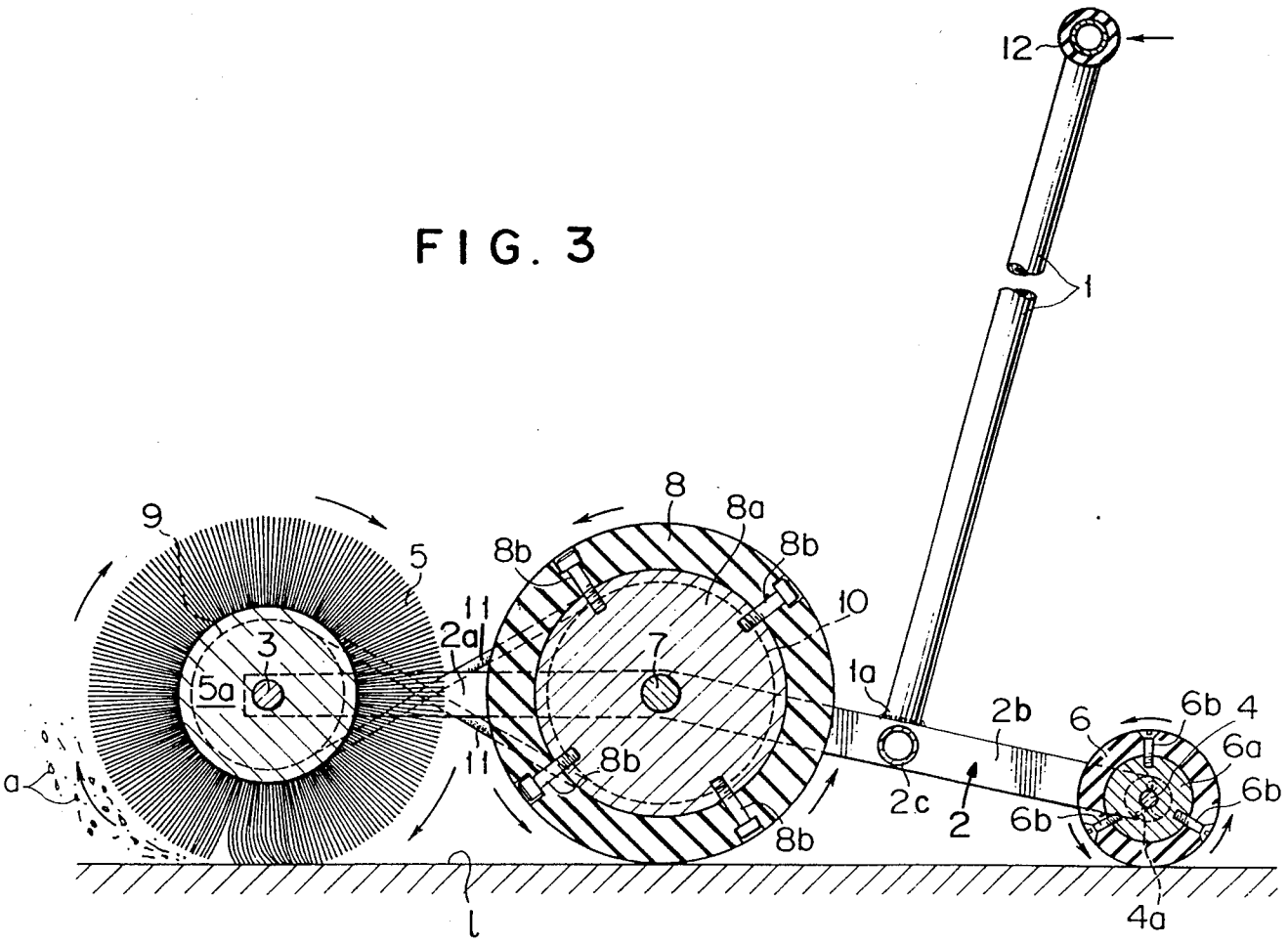
FIG. 3 is a vertical enlarged side view of the apparatus of FIG. 1.
Figure 4:
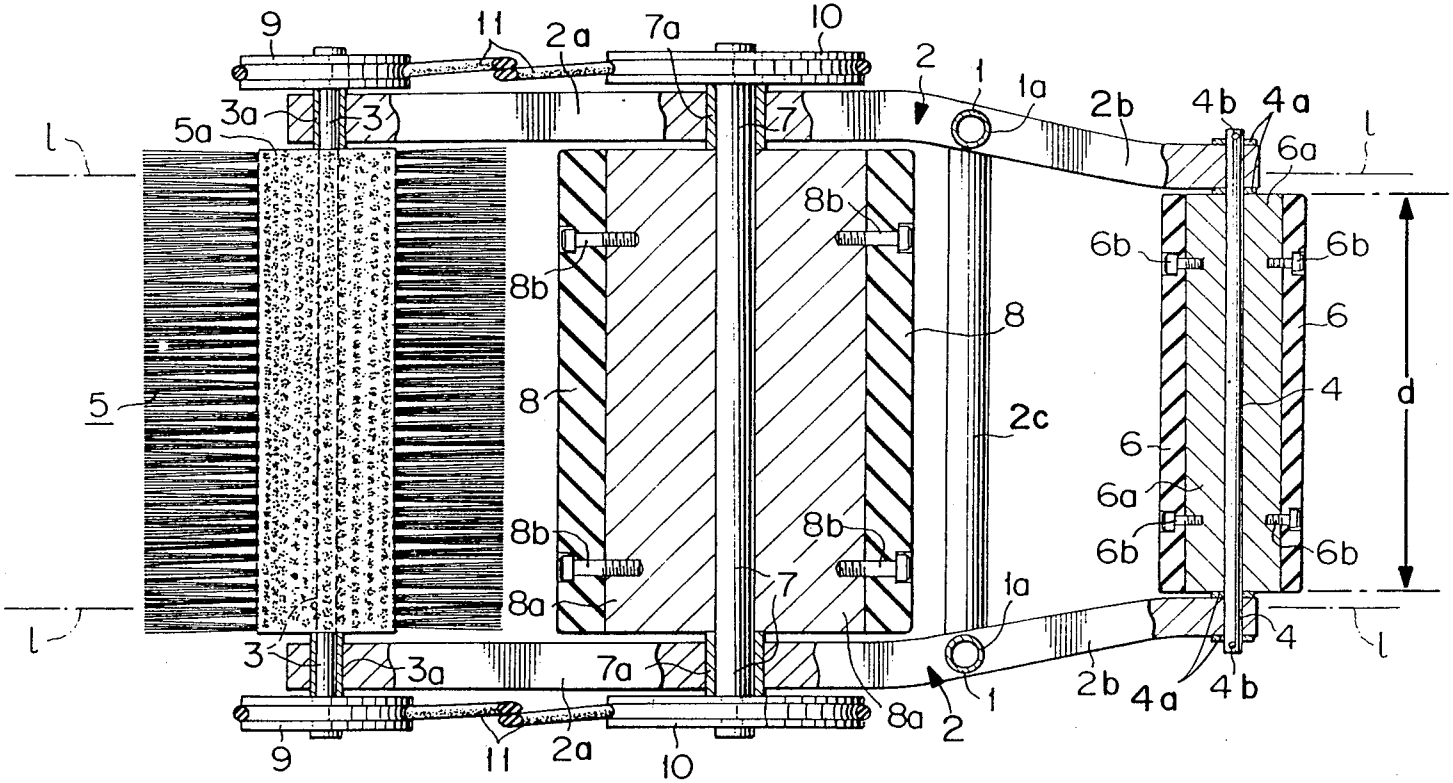
FIG. 4 is an enlarged horizontal cross-section taken along the frames in the apparatus of FIG. 1.

In FIGS. 3 and 4, reference numeral **1*a* denotes a mounting portion of the handle arm 1, 6*a* and 8*a* respectively denote a core of the secondary roller 6 and a core of the primary roller 8, 6*b* and 8*b* respectively denote set screws for fixing the secondary roller 6 to the core 6*a* and set screws for fixing the primary roller 8 to the core 8*a*, the letter a denotes dust and sand raised by the rotation of the roller brush 5**, and l denotes the surface of the line on the tennis court.

In the line cleaning apparatus according to this invention shown in FIGS. 1 to 4, the handle arms 1 made of a metal pipe are bonded to one another except along the two ends thereof. The upper ends of the handle arms 1 are bent in such a manner that they are separated from each other to form grips 12. The lower ends thereof are forked to form the mounting portions **1*a*, which are welded to the pair of frame members 2 made of a square metal pipe, as shown in FIGS. 1 and 2**.

The shaft 3 is fixed to the core 6*a* of the roller brush 5, the shaft 4 is fixed to the core 6*a* of the secondary roller 6, and the shaft 7 is fixed to the core 8*a* of the primary roller 8. Thereafter, the pair of frames 2 are mounted on the two ends of the shafts 3, 4 and 7 through bearings 3*a* and 7*a*.

The pulleys 9 and 10 are then fixed to the shafts 3 and 7, respectively and cotter pins 4*b* are mounted on the two ends of the shaft 4 so that the roller brush 5, the secondary roller 6 and the primary roller 8 can be rotatably supported on the frame members 2. The pair of frame members 2 are coupled to each other through a cross-brace 2*c*. The belt 11 is wound around the pulley 9 and 10 at each side of the rollers, the belt crossing between the pulleys to form a figure eight.

It will be particularly observed from FIG. 4 that the brush roller 5 and main roller 8 are substantially the same axial dimension as the width dimension of line 1. Moreover, the secondary roller is of lesser axial dimension d as compared to both the primary roller 8 and the width of line 1. In such a manner, therefore, "tracks" will not be left on the lateral sides of line 1 when it is cleaned by means of the present invention.

The operation of the above described structure generally comprises line cleaning apparatus of this invention will be described below. When an operator pushes the grips 12 of the handle arms 1 to roll the primary roller 8 and the secondary roller 6 on the ground along the line l, the primary roller 8 rotates. The rotational force of the primary roller 8 is transmitted to the roller brush 5 through the pulleys 10, the belts 11 and the pulleys 9, as shown by the arrows in FIGS. 1 and 3, thereby rotating the roller brush 5 in a direction reverse to that in which the primary roller 8 is rotated and at relatively higher speed, thereby sweeping the dust and sand a off the line l and its peripheral portions on the court.

Since the roller brush 5 is rotated in a direction reverse to that in which the primary roller 8 is rotated by means of the rotational force of the primary roller 8 being transmitted to the roller brush 5 through the belts 11 when the secondary roller 6 and the primary roller 8 are rolled on the surface of the line, the brush of the roller brush 5 lightly contacts the line l and raises the sand and dust a in a forwardly direction so as to clean the surface of the line l.

As is clear from the foregoing description, in the line cleaning apparatus according to the present invention, when the handle arms 1 are pushed forward, the primary roller 8 rotates, thereby responsively rotating the roller brush 5 in a direction reverse to that of the rotation of the primary roller 8 by means of the crossed belts 11. In such a manner sand and dust are reduced from the line and its peripheral portions on the court. This enables the line to be quickly and readily cleaned in one line-cleaning operation. Furthermore, since no wheel is used in this cleaning apparatus and since the secondary roller 6 is of lesser axial dimension as compared to the main roller 8 and trails the same, no wheel tracks are left at the two sides of the line, thus improving the appearance of the cleaned tennis court.

What is claimed is:

1. An apparatus to be advanced along a boundary line of preset width associated with a playing surface of a game to thereby clean the line, said apparatus comprising:

a frame having (i) a pair of frame members each of which includes a central portion and leading and trailing arm portions which extend in generally opposite directions from said central portion, said leading arm portion having a forwardmost end, and said trailing arm portion having a rearwardmost end, and (ii) a cross brace rigidly connected to and between said pair of frame members so as to laterally separate each said frame member one from the other, wherein said leading arm portions of said pair of frame members are substantially parallel to one another, whereas said trailing arm portions of said frame members converge toward one another;

roller brush means having a brush-mounting shaft for rotatably mounting said roller bursh means transversely between said pair of frame members at said forwardmost end of said leading arm portions thereof for cleaning a boundary line associated with a game's playing surface;

primary and secondary roller means for supporting said frame means for movements over the boundary line to be cleaned, said primary roller means including a roller-mounting shaft for rotatably mounting said primary roller means transversely between said pair of frame members at said central location between said forwardmost and rearwardmost ends thereof, and said secondary roller means being rotatably mounted transversely between said trailing arm portions of said pair of frame members at said rearwardmost end thereof so as to be mounted rearwardly of said primary roller means; and wherein said roller brush means and said primary roller means each establish an axial dimension corresponding to the preset width of said boundary line, and wherein said secondary roller brush means establishes an axial dimension which is less than said axial dimension of said roller brush means said primary roller means, and thus less than the preset width of said boundary line;

said apparatus further comprising pulley means operatively interconnecting said primary roller means and said brush means, said pulley means, during a boundary line-cleaning operation in which said primary roller means is rotatably advanced along a boundary line to be cleaned, for responsively rotating said roller brush means in a rotational direction which causes debris on said boundary line to be brushed forwardly of said roller bush means, whereby said boundary line is cleaned, ansd wherein said pulley means includes;

(a) a pair of pulley wheels fixedly mounted at a respective end of said brush-mounting shaft and said roller mounting shaft so as to be rotatably supported thereby, wherein each said pulley wheel is positioned laterally adjacent to an exterior side of a respective one of said frame members, wherein said respective one of said frame members is located between said pair of pulley wheels, on the one hand, and said roller brush means and said primary roller means on the other hand; and (b) a belt that extends around said pair of pulley wheels, in a configuration such that the belt crosses between the same to form a figure eight.

2. An apparatus as in claim 1, wherein said pulley means includes a second pair of pulley wheels fixedly mounted at an end of said brush-mounting shaft and said roller-mounting shaft opposite to said first mentioned pair of pulley wheels, and a second belt that extends around said second pair of pulley wheels, in a configuration such that the belt crosses between the same to form a figure eight.

* * * * *